United States Patent [19]

Steidinger

[11] Patent Number: 5,076,489

[45] Date of Patent: Dec. 31, 1991

[54] MULTI-PLY MAILER FORM AND METHOD

[75] Inventor: Donald J. Steidinger, Barrington, Ill.

[73] Assignee: Wallace Computer Services, Inc., Hillside, Ill.

[21] Appl. No.: 544,698

[22] Filed: Jun. 27, 1990

[51] Int. Cl.[5] ..... B65D 27/04

[52] U.S. Cl. ..... 229/71; 156/76; 229/69; 462/6; 493/222; 493/919

[58] Field of Search ..... 156/76; 493/222, 919; 282/11.5 R, 11.5 A, 25; 229/69, 71; 462/6

[56] References Cited

U.S. PATENT DOCUMENTS

| | | | |
|---|---|---|---|
| 1,766,416 | 6/1930 | Von Winkler | 493/222 |
| 3,104,799 | 9/1963 | Steidinger . | |
| 4,095,695 | 6/1978 | Steidinger . | |
| 4,172,605 | 10/1979 | Welsch . | |
| 4,425,386 | 1/1984 | Chang et al. . | |
| 4,448,445 | 5/1984 | Chang . | |
| 4,664,416 | 5/1987 | Steidinger . | |
| 4,729,506 | 3/1988 | Neubauer | 229/71 |

FOREIGN PATENT DOCUMENTS

| | | |
|---|---|---|
| 2209332 | 6/1974 | France . |

*Primary Examiner*—Stephen P. Garbe

*Attorney, Agent, or Firm*—Tilton, Fallon, Lungmus & Chestnut

[57] ABSTRACT

A multi-ply mailer and method of making wherein the top sheet has a CB coating, the next adjacent intermediate ply has a CF coating and the top sheet has a localized area coated with transparentizing material with image developing properties whereby impressing the localized area results in the development of an image visible through the top ply.

10 Claims, 1 Drawing Sheet

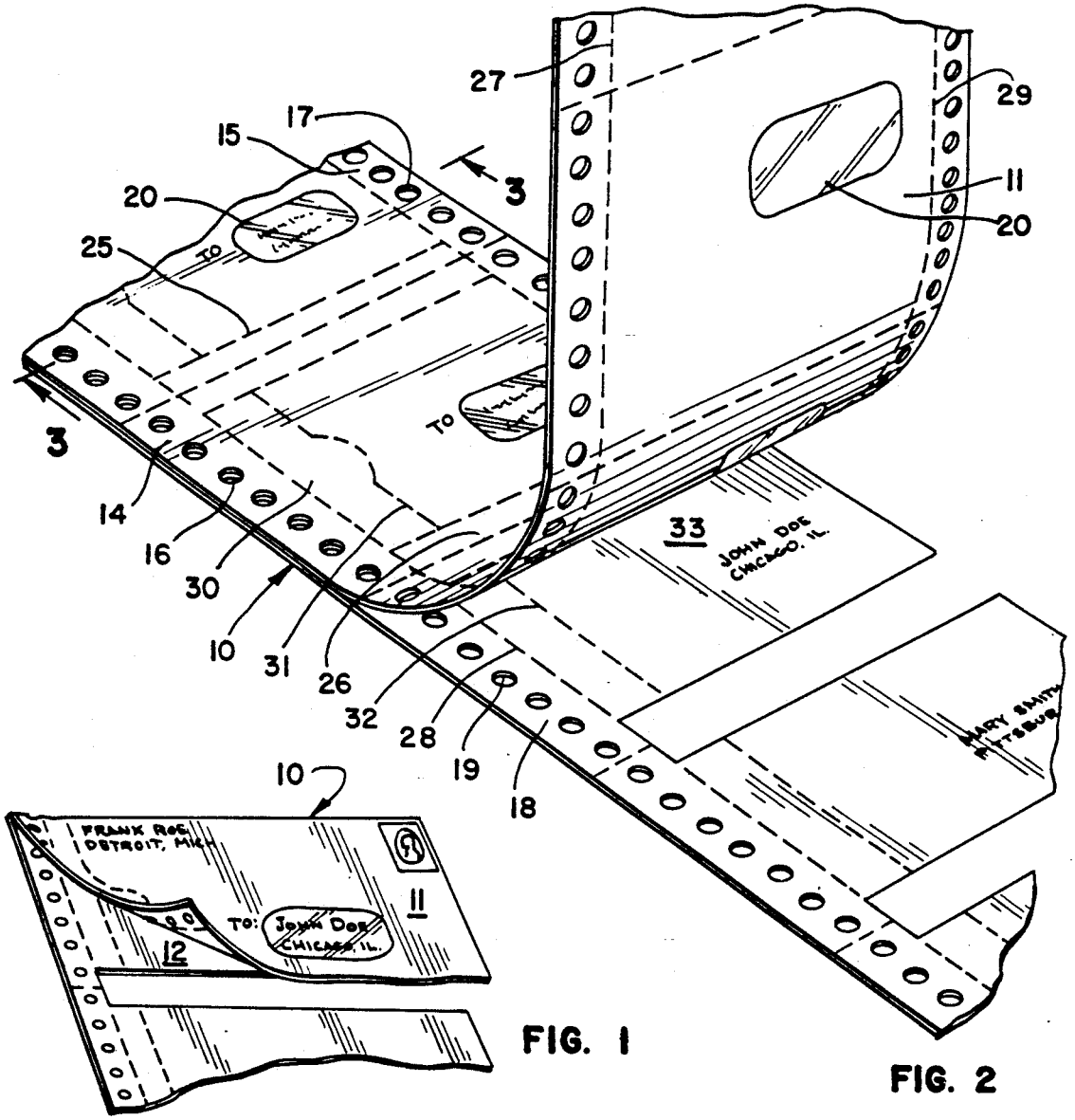
FIG. 1
FIG. 2
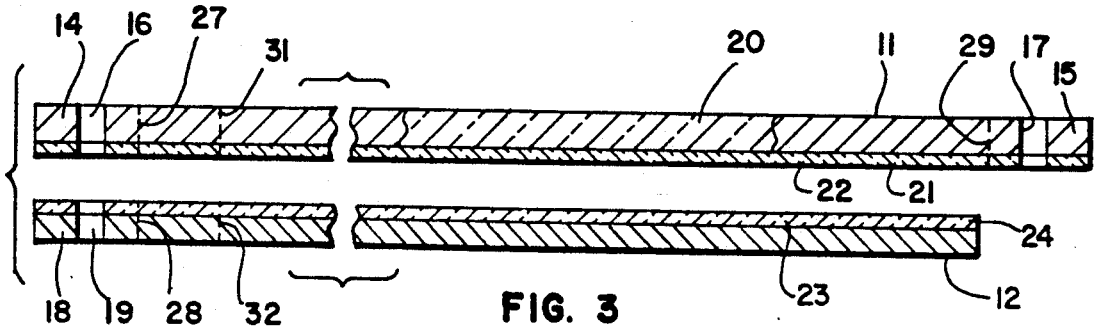
FIG. 3

MULTI-PLY MAILER FORM AND METHOD

BACKGROUND AND SUMMARY OF INVENTION

This invention relates to a multi-ply mailer form and method and, more particularly to an improved mailer form suited for use by computer impact printers to produce a message on a ply while it is inside the mailing envelope.

The invention provides for a mailer form product that does not utilize the outside copy ordinarily used for follow up, but provides the means to produce an address viewable from the outside of the mailer envelope with other computer printed message only on the inside ply.

Mailer forms of the type which are the subject of this invention were first introduced with my U.S. Pat. No. 3,104,799. These used a ply over the mailer envelope to provide the address on the outside of the envelope by use of a carbonized spot and other computer printed message only on the ply inside the mailer by means of carbon paper, carbon spots on carbonless coatings inside the mailer. The ply over the mailer was regularly filed and used later for reconciliation and follow up.

The advent of greatly increased computer memory has eliminated the need for the ply over the mailer in many business systems so new methods to provide for separating the computer printed data to be on the outgoing mailer face and that on the plies inside the mailer are needed.

The Welsch U.S. Pat. No. 4,172,605 provided for a pattern of color developer in the outgoing address area on the face of the mailer envelope. A special computer ribbon with color former impregnation is used in place of the normal ink ribbon on the computer printer to form an image when impacted only in the address area coating. This system is deficient in that the special ribbon required is expensive and has a short life in that it can be run through only once rather than many times as is common with ink ribbons.

The Chang U.S. Pat. No. 4,425,386 provides a localized coating comprising both microscopic pressure rupturable capsules containing a chromogenic material and an electron acceptor material thus resulting in a self contained carbonless coating to receive the image in the outgoing address area. A plain uncoated nylon ribbon is used to replace the ink ribbon in the computer to reduce embossing of the impact type bars and to avoid the necessity of cleaning the type bars of ink. The plain nylon ribbon is low in cost and has a long life. The deficiency of Chang is that his coating is very sophisticated, hard to formulate, and not readily available in the marketplace. Also it is difficult to apply and dry in production.

It is an object of my invention to provide for the selected address area on the face of a mailer using readily available hot melt CB coating material that does not require drying. In one advantageous embodiment, the hot melt CB coating is used to also transparentize the face of the mailer to provide a window through which to view the address formed on the inside ply.

I had previously suggested in U.S. Pat. No. 4,664,416 the use of translucent material in a web in conjunction with an underlying carbon tissue and an overlying label. However, this translucency was of no value until the label and underlying carbon tissue was removed. In contrast, I provide here a transparent area from the very beginning—as would be required in a mailer because there is no provision in its operation for label or underlying carbon tissue removal.

It is further advantageous to add to the hot melt CB coating a small amount of adhesive to cause the transparentized window area to adhere lightly to the inside ply to enhance visibility through the address window but still enable the inside ply to be removed readily from the envelope.

The invention is described in conjunction with the accompanying drawing, in which—

FIG. 1 is a fragmentary perspective view of a mailer of current manufacture to which the instant invention is applicable;

FIG. 2 is a fragmentary enlarged perspective view featuring the application of the invention thereto; and FIG. 3 is an enlarged exploded section view such as would be seen along the sight line 3—3 applied to FIG. 2.

DETAILED DESCRIPTION

Referring first to FIG. 1, the numeral 10 designates generally a mailer of current manufacture such as is described in detail in my U.S. Pat. No. 3,104,799. The mailer includes a top ply 11, and an intermediate ply 12 Other intermediate plies and the bottom ply have been omitted for ease of presentation and understanding. In accordance with conventional practice additional intermediate plies between the top ply 11 may be provided as well as a return envelope.

The top ply 11 is equipped with the usual control punch margins 14 and 15 having line holes therein as at 16 and 17. The intermediate ply 12 has one control punch margin as at 18 and which is equipped with line holes as at 19. In accordance with the invention, the top ply has a transparentized window 20 and on its undersurface 21 a CB coating 22. The intermediate ply immediately adjacent the top ply 11 and which is designated 12 in the illustration given is equipped on its upper surface 23 with a CF coating 24.

To develop the transparentized window 20, I apply a transparentizing material to a localized area of the inner surface 21 of the top ply 11. Advantageously, the material applied can include a wax-like material and CB capsules. Further, I have found it advantageous to apply heat and pressure to the localized area 20 incident to the application of the transparentizing material so as to impregnate the top ply 11. Advantageously, the pressure is from about 5 to about 20 psi and the heat is sufficient to elevate the temperature of the transparentizing material above about 160° F. The transparentizing material is applied in an amount from about 2 to about 5 times the amount per unit area of the CB coating. Still further, I have found it advantageous to incorporate an adhesive material into the transparentizing coating to render the same slightly tacky, the adhesive constituting from about 2% to about 15% by weight of the transparentizing material applied to the localized area 20.

Excellent results are obtained utilizing as the transparentizing material either wax or oil and it is preferred that the transparentizing material also contain CB capsules. This then provides a procedure completely compatible with normal manufacturing procedures for mailers.

MANUFACTURING PROCEDURE

As can be seen from FIG. 1, the mailer consists of continuous plies or webs of material (usually paper) which are prepared individually on a press and thereafter brought together in superposed relation in a collator. At the press, not only is the continuous web equipped with printed indicia but also may be line hole punched, cross perforated, etc. Either before or during printing operation, the underside 21 of the ply 11 can be coated with CB capsules and spot coated with the transparentizing material for the localized area 20.

The next adjacent ply 12 is coated on its upper surface with a CF coating and both webs along with any other webs and including the bottom ply 13 are then re-reeled into parent rolls. These rolls are then transferred to a collator where they are unwound and arranged in superposed relation so as to form a continuous multi-ply product, i.e., a connected series of stuffed sealed envelope assemblies.

Normally, the string of envelope assemblies is zig-zag or fan folded, cartoned and transferred to the plant or business of the ultimate user. The envelope strings are then fed through a computer printer to receive variable information, i.e., the addressee, billing or other financial information, grades or other personal information, etc. The individual mailers are then burst along the aligned lines of perforation as at 25 and 26 (see FIG. 2) and mailed. Normally, the control punch margins 14, 15 are detached along the longitudinal perforation lines 27–29. After receipt, removal of the side tab 30 by tearing along the perforation lines 31, 32 frees the intermediate ply portion 33—see FIG. 2.

In contrast to the past, there is no longer the office or extra top ply which in many cases was thrown away but which could increase the bulk of the mailer 25%. Now, the computer printer by striking the localized area 20 through the nylon ribbon with the addressee information creates an image at the interface of the CB and CF coatings which is readily visible through the transparentized window 20. I have found it advantageous to make the transparentizing material slightly tacky so as to adhere the localized area 20 to the top of the intermediate ply 12, thereby bringing the CB and CF coatings into intimate contact. This results in better readability during mail processing but is insufficient to inhibit easy ply separation when the mailer is received by the addressee.

It is believed that the invention can be further appreciated from a specific example of the practice thereof.

EXAMPLE

In the above mentioned method of producing, the webs 11 and 12 are equipped with CB and CF coatings, respectively of conventional manufacture. Incident to the coating of the top ply 11, I additionally coat the localized area 20 with a transparentizing material which includes a wax such as Carnuba and Montan obtained from M. Argueso & Co. Inc., Mamarneck, N.Y. This wax is mixed so as to constitute 70% of the total transparentizing material with 30% being CB capsules of Type Micronel-S obtained from SASF Corporation of Parsippany, N.J.

When the transparentizing material is applied, I arrange the nip between the coating and backup rolls to apply approximately 10 psi.

I also have added about 5% by weight of an adhesive such as Type 6534 obtained from HB Fuller Co., St. Paul, Minn.

I claim:

1. A multi-ply mailer form having an envelope front and an envelope back comprising a plurality of sheets in superposed relationship wherein the top sheet constitutes the mailer envelope front, said top sheet having an outer and inner surface, a CB coating extending substantially entirely over said inner surface, the sheet of said multi-ply form adjacent said top sheet having a CF coating extending substantially entirely over the surface of said adjacent sheet confronting said top sheet inner surface, said top sheet inner surface having a localized area coating of a transparentizing material containing CB capsules whereby impressing said localized area results in the development of an image on said confronting surface visible through said top sheet.

2. The form of claim 1 in which said transparentizing material contains about 30% CB capsules.

3. The form of claim 1 in which said transparentizing material includes a member selected from the class consisting of wax and oil.

4. The form of claim 1 in which said coating of transparentizing material is slightly tacky to adhere said localized area to said confronting surface during mail processing but insufficient to inhibit easy ply separation.

5. A method of producing a multi-ply mailer form having an envelope front and an envelope back, comprising superposing a plurality of sheets, one of said sheets being an outer sheet to constitute the mailer envelope front and having outer and inner surfaces, prior to said superposing, applying a CB coating over substantially the entire inner surface of said outer sheet, and also prior to said superposing applying a transparentizing material containing CB capsules to a localized area of said top sheet inner surface, and applying a CF coating substantially over the entire confronting surface of the sheet adjacent said outer sheet.

6. The method of claim 5 in which said transparentizing material includes about 70% of a wax-like material and about 30% of CB capsules.

7. The method of claim 5 in which heat and pressure area applied to said localized area incident to application of said transparentizing material to impregnate said outer sheet.

8. The method of claim 7 in which said pressure is from about 5 to about 20 psi and said heat is sufficient to elevate the temperature of said transparentizing material above about 160° F.

9. The method of claim 5 in which said transparentizing material is from about 2 to about 5 times the amount per unit area of said CB coating.

10. A method of producing a multi-ply mailer form having an envelope front and an envelope back comprising superposing a plurality of sheets, one of said sheets being an outer sheet to constitute the mailer envelope front and having outer and inner surfaces, prior to said superposing, applying a CB coating over substantially the entire surface of said outer sheet, and also prior to said superposing applying a transparentizing material containing CB capsules to a localized area of said top sheet inner surface, and applying a CF coating substantially over the entire confronting surface of the sheet adjacent said outer sheet an adhesive material being incorporated into said transparentizing coating to render the same slightly tacky, said adhesive constituting from about 2% to about 15% by weight of said transparentizing material.

* * * * *